US011512414B2

(12) United States Patent
Gerth et al.

(10) Patent No.: US 11,512,414 B2
(45) Date of Patent: Nov. 29, 2022

(54) METHOD, DEVICE, MOVABLE CARRIAGE AND DRAWING-IN MACHINE

(71) Applicant: Groz-Beckert KG, Albstadt (DE)

(72) Inventors: Christian Gerth, Meersburg (DE); Stefan Kailer, Meßstetten (DE); Bernd Pfeffer, Haigerloch (DE); Michael Acker, Albstadt (DE); Karl-Heinz Gesing, Raesfeld (DE)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 17/619,916

(22) PCT Filed: Jun. 4, 2020

(86) PCT No.: PCT/EP2020/065439

§ 371 (c)(1),
(2) Date: Dec. 16, 2021

(87) PCT Pub. No.: WO2020/254117

PCT Pub. Date: Dec. 24, 2020

(65) Prior Publication Data

US 2022/0205149 A1 Jun. 30, 2022

(30) Foreign Application Priority Data

Jun. 17, 2019 (EP) ..... 19180586

(51) Int. Cl.
*D03J 1/14* (2006.01)

(52) U.S. Cl.
CPC ..... *D03J 1/14* (2013.01)

(58) Field of Classification Search
CPC ..... D03J 1/14; D03J 1/00; D03J 1/001; D03J 1/12; D03J 5/00; D03J 2700/00;
(Continued)

(56) References Cited

U.S. PATENT DOCUMENTS 2,445,999 A * 7/1948 Drake ..... D03J 1/14 28/207
2,671,943 A * 3/1954 Rovas ..... D02H 13/16 28/213

(Continued)

FOREIGN PATENT DOCUMENTS

CN 205529299 U 8/2016
CN 106048866 A 10/2016

(Continued)

OTHER PUBLICATIONS

Extended European Search Report and Written Opinion dated Jan. 3, 2020, in corresponding European Application No. 19180586.0, with machine English translation (12 pages).

(Continued)

*Primary Examiner* — Amy Vanatta

(74) *Attorney, Agent, or Firm* — Fitch, Even, Tabin & Flannery LLP

(57) ABSTRACT

A method and a device for the automated transport of weaving accessories is disclosed. A device is provided which has at least one rail and at least one rail carrier. The at least one rail carrier carries the weight of the at least one rail, on which weaving accessories can be movably disposed in the longitudinal direction of the rail. The method is characterized in that the at least one rail carrier is displaced relative to the at least one rail, in the longitudinal direction thereof, in order to move weaving accessories disposed at the rail along the rail in the longitudinal direction thereof.

16 Claims, 1 Drawing Sheet

(58) Field of Classification Search
CPC ..... D03J 2700/10; D03J 2700/12; D03J 2700/14; D03J 2700/16; F16M 13/00; F16M 11/42; F16M 11/425; D02H 11/00; D02H 13/00; D02H 13/02; D03D 49/00; D03D 49/02; D03D 49/025
USPC ..... 28/203.1, 204, 205; 248/659, 646, 558, 248/682, 688, 689
See application file for complete search history.

(56) References Cited

U.S. PATENT DOCUMENTS 3,121,936 A * 2/1964 Meierhofer ..... D03J 1/14 28/206
3,136,025 A * 6/1964 Noone ..... D03J 1/14 28/205
3,744,109 A * 7/1973 Dohi ..... D03J 1/14 28/206
4,499,638 A * 2/1985 John ..... D03J 1/14 28/207
5,136,762 A * 8/1992 Gironi ..... D03J 1/14 28/201
5,287,605 A * 2/1994 Badertscher ..... D03J 1/14 28/207
5,361,467 A 11/1994 Jaeger et al.
5,394,596 A * 3/1995 Lindenmuller ..... D03J 1/001 28/208
5,448,812 A * 9/1995 Wolf ..... D03J 1/14 28/208
5,459,913 A * 10/1995 Lechner ..... D03J 1/14 28/208
5,475,906 A * 12/1995 Magdika ..... D03J 1/14 28/208
6,397,443 B1 6/2002 Good et al.
2003/0226609 A1* 12/2003 Farner ..... D03C 7/06 139/11
2004/0025311 A1* 2/2004 Kjellberg ..... D06F 31/00 26/1

FOREIGN PATENT DOCUMENTS

DE 688493 C 2/1940
DE 69111171 T2 3/1996
EP 0496232 A1 7/1992
GB 191111443 A 5/1911

OTHER PUBLICATIONS

International Search Report and Written Opinion dated Sep. 17, 2020, in corresponding International Application No. PCT/EP2020/065439, with machine English translation (13 pages).
European Intent to Grant dated Oct. 19, 2021, in corresponding European Application No. 19180586.0, with machine English translation (11 pages).

* cited by examiner

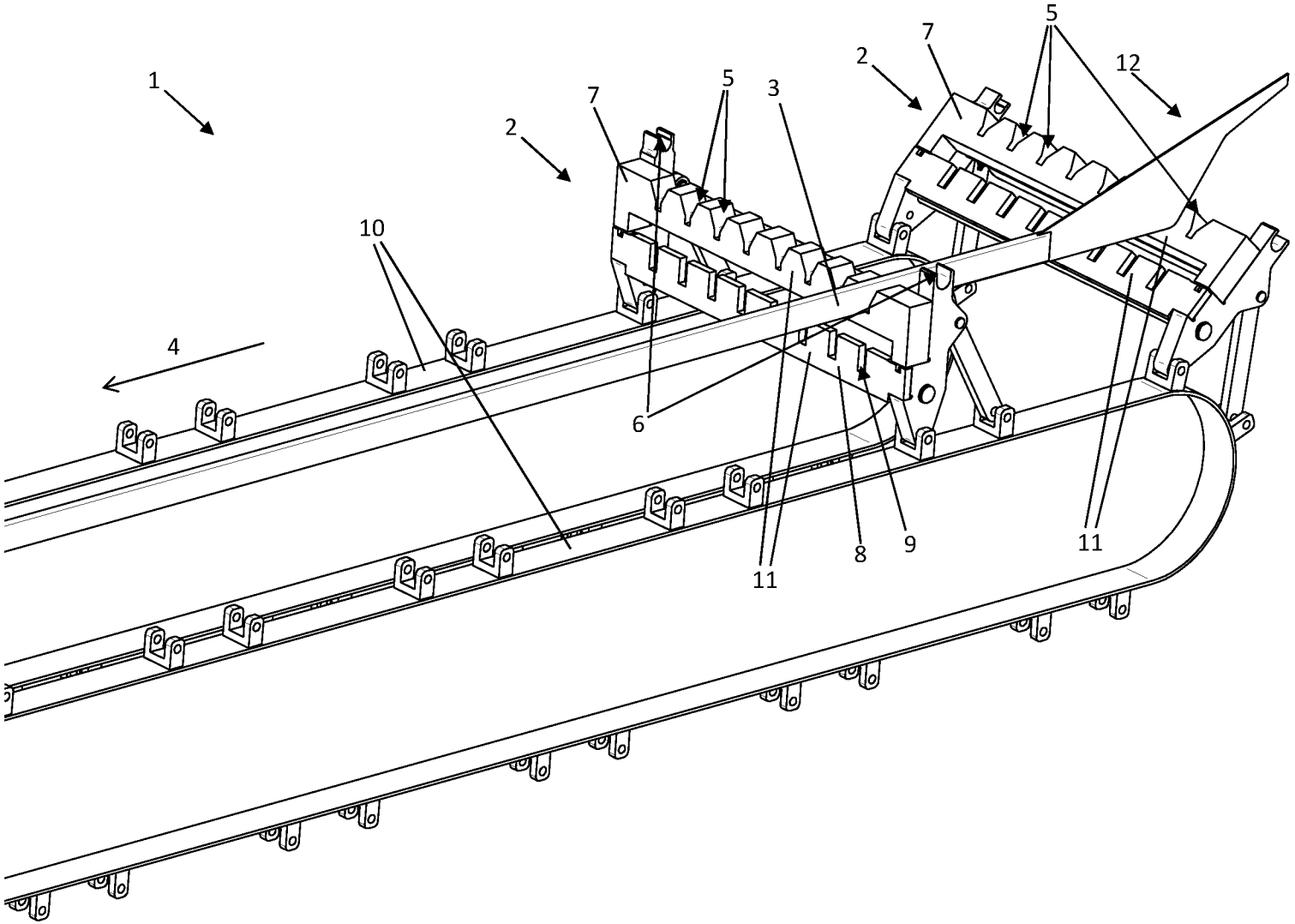
1
2
2
3
4
5
5
6
7
7
8
9
10
11
11
12

METHOD, DEVICE, MOVABLE CARRIAGE AND DRAWING-IN MACHINE

CROSS REFERENCE TO RELATED APPLICATIONS

This patent application is the national phase of PCT/EP2020/065439, filed Jun. 4, 2020, which claims the benefit of European Patent Application No. 19180586.0, filed Jun. 17, 2019.

TECHNICAL FIELD

The invention relates to a method and a device for the automatic transport of weaving accessories, for example drop wires and healds. Devices of this kind have become known, for example as components of a mobile trolley of drawing-in machines. The present invention focuses on the transport of warp stop-motion drop wires. In so far, when speaking of weaving accessories, the focus is preferably on drop wires but healds are not excluded. A drawing-in machine is a machine for drawing (warp) threads into weaving accessories. It can be broken down into various functional units and has corresponding devices and components thereof. These include, for example, devices for the supply of healds and drop wires through which threads will be drawn. In these supply devices, the weaving accessories are suspended contiguously on rail-like guideways, as is generally the case, for example, for sales purposes or during weaving. On the so-called "loading side", additionally, a device is needed for holding a reed in readiness. The central device in a drawing-in machine is a drawing-in device that typically guides the threads through reed, heald, drop wire and through components of a lease. On the "unloading side", the drawn-in drop wires and healds have to be transported away from the vicinity of the drawing-in device in order to prevent backward congestion. In the drawing-in device, healds and drop wires are mostly transported fast over short distances in order to achieve a high drawing-in repetition rate. After being drawn in, the weaving accessories have to be pushed over mostly lengthy, rail-like guideways. Their removal is mostly slow, although the weaving accessories have to travel relatively large distances. These are typically 2 to 3 m, but sometimes distances of up to 6 m are required. On the "unloading side", drop wires and healds are often transported away parallel, in devices arranged beside each other. These transport jobs have not been satisfactorily automated, at least not for all types of weaving accessories (such as drop wires and healds). Frequently, a drawing-in machine operator has to push weaving accessories manually over the rails.

BACKGROUND

The DE688493C1 discloses a drawing-in machine in which singularized drop wires are transported by carrier rods, which engage at the upper end of the drop wires suspended on a rail, from a separation unit to a drawing-in unit and then a short distance away from this drawing-in unit. The complicated structure above the rails on which the drop wires are suspended is not suitable for transporting the drop wires further along the drop-wire carrier rails, so that the drop wires have to be pushed further manually from time to time.

The EP496232A1 discloses a drawing-in machine in which the drop wires can be transported and distributed over the entire length of a drop-wire carrier rail by means of a rotating threaded spindle. However, the drive means for the threaded spindle necessitates a large number of additional parts that make the whole device expensive and difficult to operate. Furthermore, transport by means of the threaded spindle in unreliable and it is prone to wear, so that the quality of the drop wires may also be impaired.

SUMMARY

Starting from this prior art, the object of the present invention is to provide a reliable and yet inexpensive method and device for the automatic and quality-preserving transport of weaving accessories over a longitudinally extending rail.

The method according to the invention for the automated transport of weaving accessories comprises the provision of a device comprising at least one rail and at least one rail carrier. The at least one rail carrier carries the weight of the at least one rail, on which weaving accessories are movably disposed in the longitudinal direction of the rail. The method according to the invention is characterised by displacement of the at least one rail carrier relative to the at least one rail, in the longitudinal direction thereof, in order to move weaving accessories disposed at the rail along the rail in the longitudinal direction thereof. Transport of the weaving accessories along the rails is effected by rail carriers, which embrace and support the rails from below and simultaneously have large-area contact points for drop wires. Displacement of the rail carriers leads to simultaneous displacement and transportation of the drop wires disposed at the rails.

Thanks to the rail carriers performing the combined functions of support and transportation, additional parts that make the device more expensive and more problem-prone are superfluous. Furthermore, the large-area contact with the rail carriers enables the drop wires to be transported more gently, thereby preventing any impairment in their quality.

The rail carriers may be displaced intermittently, in particular only at times when no new weaving accessories are being lined up at the rail end closer to the drawing-in device. This practice prevents collisions between the rail carriers and the weaving accessories. A plurality of weaving accessories can thus be transported between each two rail carriers.

At least one rail carrier can be displaced from one end of the at least one rail to the other end of the at least one rail in the longitudinal direction thereof, thereby enabling weaving accessories to be moved over the entire length of the rail and to be distributed evenly as required. In particular, a rail carrier which, as the first of the rail carriers, makes contact with the weaving accessories at the end of the rail closer to the drawing-in machine, can be displaced intermittently until it reaches the end of the rail further away from the drawing-in machine, thereby transporting the weaving accessories that were drawn in first over the entire length of the rail.

The device according to the invention for the automated transport of weaving accessories comprises at least one rail on which weaving accessories can be movably deposed in the longitudinal direction of the rail. In addition, the device comprises at least one rail carrier, which is disposed in such a manner that it can carry the weight of the at least one rail. The device according to the invention is characterised by rail carriers of the device, which are disposed movably relative to the at least one rail in the longitudinal direction thereof and which embrace and support the rails from below and simultaneously have large-area contact points for drop wires suspended on the rails.

Thanks to the rail carriers performing two different functions, additional parts that make the device more expensive and more problem-prone are superfluous. Furthermore, the drop wires are transported more gently, thereby preventing any impairment in their quality, on account of the large-area contact with the rail carriers.

The at least one rail may be safeguarded against displacement in the longitudinal direction. It is preferable for the at least one rail to be safeguarded, for example clamped, against longitudinal displacement at its end distant from the drawing-in machine. At this end, the rail, too, may be supported by means other than a movable rail carrier, for example by a fixed rail carrier. On account of the movement of the rail-supporting rail carriers relative to the rails, the rails will always experience a force that wants to move the rails with the rail carriers. These forces may be transferred to a fixed rail carrier, for example, at the rail end distant from the drawing-in device.

The at least one rail carrier may comprise at least one groove for accommodating the at least one rail. The groove prevents the rails from tipping sideways. The groove preferably embraces the entire rail, thereby providing as large a contact surface as possible between the rail carrier and a weaving accessory suspended from the rail.

The at least one rail carrier may comprise contact surfaces disposed at right angles to the longitudinal direction of the at least one rail so as to be able to move weaving accessories disposed at the rail in the longitudinal direction of the at least one rail. It is advantageous if at least the contact surfaces of the rail carrier comprise plastic or consist of plastic. The plastic may be friction-reducing.

The at least one rail carrier may have a means for mounting an element for the parallel automated transport of weaving accessories of a different kind. For example, the rail carriers may have, at their upper end, a receptacle into which, for example, a bar-shaped element can be inserted. A bar inserted in this way can engage a laterally adjacent device in which weaving accessories of a different kind, for example healds, are suspended. This makes it possible to transport healds, for example, parallel to the drop wires. The means for receiving the bar-shaped element and the bar may be configured in such a way that they can be joined manually, for example by clipping in the bar or by means of similar releasable connections. It is advantageous if the means on the rail carrier is made of plastic.

The at least one rail carrier is preferably of multipart construction, enabling an upper part of the at least one rail carrier to be removable. The upper part may, for example, be upwardly removable. The upper part may, for example, be held magnetically to the rail carrier, enabling its manual removal without the need for a tool. This configuration may, as explained later, be advantageous particularly for unloading after drawing-in has taken place.

The at least one rail carrier may have, in a lower part, at least one groove for accommodating a contact rail. This configuration enables unloading to be effected advantageously as follows: when all the weaving accessories have been drawn in and transported via the rails, the (toothed) contact rails for a warp stop motion can be inserted into the lower parts of the rail carriers. Then the rails from which the weaving accessories are suspended can be withdrawn, so that the weaving accessories are now suspended from the contact rail. After the upper parts of the rail carriers have been removed, the weaving accessories can finally be removed and inserted into a warp stop motion.

The at least one rail carrier may be disposed to be movable over the entire length of the rail. In particular, the at least one rail carrier may be mounted on at least one endlessly revolving element. The endless element can be a belt, a chain or something similar. The revolving element can extend beneath the rails over their entire length. In addition, a means for driving the endless element may be provided, for example an electric motor.

The invention furthermore includes a mobile trolley having a device according to the invention. It is thus possible to remove the drawn-in weaving accessories rapidly from the working area of a drawing-in machine and to couple an appropriately prepared trolley to a drawing-in machine in order to keep the downtime of a drawing-in machine short.

The invention also includes a drawing-in machine having a device according to the invention, which may be mounted on a mobile trolley.

BRIEF DESCRIPTION OF THE DRAWINGS

FIG. 1 shows a symbolic, partly oblique view of major components of the device according to the invention.

DETAILED DESCRIPTION

FIG. 1 shows a systematic, partly oblique view of major components of the device 1 according to the invention. For purposes of clarity, only the part of the device 1 is shown, which adjoins a non-portrayed drawing-in device. The device 1 comprises two parallel endless elements 10 in the form of belts. Each of these is joined at the end of the device 1 that is not shown, so that two revolving endless belts 10 exist. Two rail carriers 2 are shown, of which the rail carrier 2 on the right has not yet engaged the rail 3 in the drawing. In this state, non-portrayed drop wires can be loaded from the right onto the rail 3 via the incline 12 at the end of the rail 3. Once a pre-determined number of drop wires has been loaded, the belts 10 can be powered so that the rail carriers 2 are displaced to the left in the longitudinal direction 4. The rail carrier 2 shown on the right then swivels beneath the rail 3, embracing the rail with one of its grooves 5 in its upper part 7 and thereby enabling it to transport the drop wires suspended from the rail 3 to the left, in longitudinal direction 4. The rail carriers 2 offer the drop wires relatively large contact surfaces 11, so that the drop wires are transported reliably damage-free. The rail carriers 2 comprise a lower part 8 with grooves 9, into which contact rails for warp stop motions can be inserted below the rail 3. The rail carriers 2 also comprise, at their upper end, two means 6 shaped as semi-shells, into which an appropriate, non-portrayed bar can be clip-fitted. This configuration enables non-portrayed healds, which may be arranged in a non-portrayed device beside the device according to the invention, to be transported parallel and automatically together with the drop wires when an operator clips in the corresponding bar.

| List of reference numerals | |
|---|---|
| 1 | Device |
| 2 | Rail carrier |
| 3 | Rail |
| 4 | Longitudinal direction of rail 3 |
| 5 | Groove for accommodating rail 3 |
| 6 | Means for mounting an element |
| 7 | Removable upper part of rail carrier 2 |
| 8 | Lower part of rail carrier 2 |
| 9 | Groove in lower part |
| 10 | Endless element |
| 11 | Contact surface of rail carrier 2 |
| 12 | Incline |

The invention claimed is:

1. A method for the automated transport of weaving accessories, involving a device (1), which comprises at least one rail (3) and at least one rail carrier (2), the method comprising:

the at least one rail carrier (2) carrying a weight of the at least one rail (3), and the at least one rail (3) allowing weaving accessories to be movably disposed thereon in a longitudinal direction (4) of the at least one rail (3); and displacing the at least one rail carrier (2) relative to the at least one rail (3) in the longitudinal direction (4) thereof in order to move a weaving accessory disposed on the rail (3) along the rail (3) in the longitudinal direction (4) thereof.

2. The method according to claim 1, wherein displacing the at least one rail carrier (2) relative to the at least one rail (3) includes intermittently displacing the at least one rail carrier (2) relative to the at least one rail (3).

3. The method according to claim 1, further comprising displacing the at least one rail carrier (2) from one end of the at least one rail (3) to another end of the at least one rail (3) in the longitudinal direction (4) thereof.

4. A device (1) for the automated transport of weaving accessories, the device comprising:

at least one rail (3) configured to allow weaving accessories to be movably disposed thereon in a longitudinal direction (4) of the at least one rail (3), and at least one rail carrier (2) configured to carry a weight of the at least one rail (3), wherein the at least one rail carrier (2) is movably disposed relative to the at least one rail (3) in the longitudinal direction (4) of the at least one rail (3).

5. The device (1) according to claim 4, wherein the at least one rail (3) is fixed against displacement in the longitudinal direction (4).

6. The device (1) according to claim 4, wherein the at least one rail carrier (2) comprises at least one groove (5) for accommodating the at least one rail (3).

7. The device (1) according to claim 4, wherein the at least one rail carrier (2) comprises contact surfaces (11) arranged orthogonally to the longitudinal direction (4) of the at least one rail (3) for allowing weaving accessories disposed on the rail (3) to be moved in the longitudinal direction (4) of the at least one rail (3).

8. The device (1) according to claim 4, wherein the at least one rail carrier (2) comprises means (6) for mounting an element configured for the parallel automated transport of weaving accessories of a different kind than the weaving accessories.

9. The device (1) according to claim 4, wherein the at least one rail carrier (2) is of a multipart construction and an upper part (7) of the at least one rail carrier (2) is removable.

10. The device (1) according to claim 9, wherein the at least one rail carrier (2) comprises a lower part (8) including at least one groove (9) for accommodating a contact rail.

11. The device (1) according to claim 4, wherein the at least one rail carrier (2) is movable along an entire length of the rail (3).

12. The device (1) according to claim 4, wherein the at least one rail carrier (2) is mounted on at least one endless revolving element (10).

13. The device (1) according to claim 12, further comprising means for driving the endless revolving element (10).

14. A mobile trolley for weaving accessories, comprising the device (1) according to claim 4.

15. A drawing-in machine comprising the mobile trolley according to claim 14.

16. A drawing-in machine, comprising the device according to claim 4.

* * * * *